United States Patent [19]

Willis

[11] Patent Number: 4,476,768

[45] Date of Patent: Oct. 16, 1984

[54] DRUMSTICK

[76] Inventor: Ward L. Willis, P.O. Box 95, Breinigsville, Pa. 18031

[21] Appl. No.: 419,985

[22] Filed: Sep. 20, 1982

[51] Int. Cl.[3] ..... G10D 13/02

[52] U.S. Cl. ..... 84/422 S; D17/22

[58] Field of Search ..... D17/22; 84/422 S

[56] References Cited

U.S. PATENT DOCUMENTS

| | | | |
|---|---|---|---|
| D. 152,877 | 3/1949 | Geldard | 84/422 S X |
| 807,493 | 12/1905 | Phillips | 84/422 S |
| 3,165,964 | 1/1965 | Stys et al. | 84/422 S |
| 3,866,508 | 2/1975 | Huslig | 84/422 S |
| 4,300,438 | 11/1981 | Handal | 84/422 S |

*Primary Examiner*—Lawrence R. Franklin

*Attorney, Agent, or Firm*—James C. Simmons

[57] ABSTRACT

A drumstick having a non-bulbous tip and a grip portion to facilitate holding of the stick. The tip is characterized in that the end of the stick is sharply tapered ending in a point.

1 Claim, 1 Drawing Figure

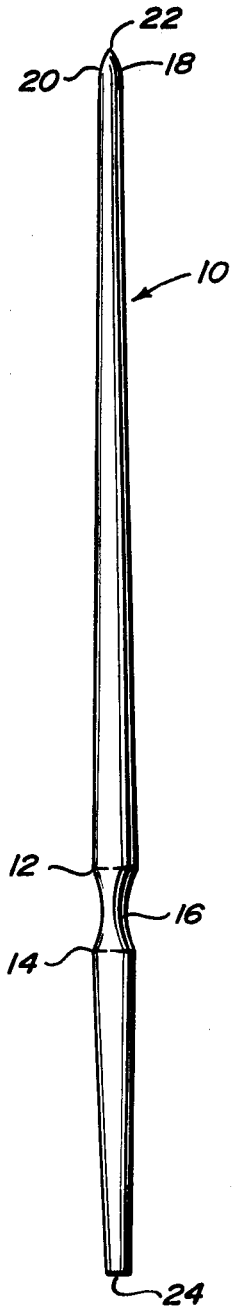
22
20
18
10
12
16
14
24

DRUMSTICK

TECHNICAL FIELD

The present invention pertains to a drumstick used by a musician to play a percussion instrument such as a snare drum.

BACKGROUND OF THE PRIOR ART

Conventional drumsticks usually have a first end containing a bulbous protrusion which is rounded and provides the striking surface for the stick on the instrument. From the first bulbous end to the other end, the stick is gently tapered along its entire length.

SUMMARY OF THE INVENTION

The present invention concerns a drumstick that has a non-bulbous tip and is fabricated with a grip section to facilitate playing by the musician. The instrument contacting end of the new stick is sharply tapered to a point. Between the end of the stick body containing the tip and the other end of the stick there is a reduced diameter portion, preferably having a concave cylinder shape positioned not only to allow the drummer to more comfortably and positively grip the stick but to predetermine the balance point of the stick.

BRIEF DESCRIPTION OF THE DRAWING

The single FIGURE of the drawing is a front elevational view of a drumstick according to the present invention.

DETAILED DESCRIPTION OF THE PREFERRED EMBODIMENT

Referring to the drawing, drumstick 10 is made from a stick, bar or rod of conventional drumstick material having a uniform diameter proximate that of the maximum diameter portion of the finished stick as at 12, 14 of the body of stick 10, while allowing for fabrication and finishing of the stick 10. When stick 10 is fabricated, a reduced diameter portion 16 is fabricated into the body at the location where the stick will be held by a musician for playing percussion instruments and in particular small drums, i.e. nonbass drums. Reduced diameter portion 16 preferably has the shape of a cylinder with concave walls of smooth curvature between locations 12 and 14 of stick 10.

Between location 12 and the beginning of the first or end tip 18 at location 20 of stick 10 the body of stick 10 is gradually tapered to a smaller cross-sectional diameter at 20 than at 12. Tip 18 is made by sharply tapering the end of the stick to a point 22.

Between location 14 and the second end 24 of the stick, which end is on a plane generally perpendicular to the longitudinal axis of stick 10, the body of stick 10 is tapered so that the diameter of end 24 is smaller than the diameter of the stick at 14.

Sticks according to the present invention can be precisely balanced by locating reduced diameter portion 16 according to the weight of the finished stick and can be fabricated with the reduced diameter portion of a shape to facilitate different size hands and playing styles.

Having thus described my invention, what is desired to be secured by Letters Patent of the United States is set forth in the appended claims.

I claim:

1. A drumstick of the type used by a musician for playing a percussion instrument such as a drum being of a unitary elongated body having a generally circular cross-section with a first or striking end sharply tapered to a slightly rounded point and a second end terminating in a plane generally perpendicular to the longitudinal axis of the drumstick and intermediate the first and second ends a portion of the drumstick body being of reduced diameter and of a concave cylindrical shape to facilitate holding of the stick for playing, said reduced diameter portion being spaced from said second end according to the weight of the finished drumstick; between said portion of reduced diameter and said first end the entire length of the stick is gradually tapered to a diameter at the point where the tip is sharply curved which is less than the largest diameter of the stick; and between said portion of reduced diameter and said second end the entire length of the stick is gradually tapered with the second end of the stick having a diameter smaller than the maximum diameter of the stick.

* * * * *